US009413094B2

(12) United States Patent
Qi et al.

(10) Patent No.: US 9,413,094 B2
(45) Date of Patent: Aug. 9, 2016

(54) TERMINAL FOR AN ELECTRICAL CONNECTOR

(71) Applicant: Advanced-Connectek Inc., New Taipei (TW)

(72) Inventors: Xiao-Juan Qi, New Taipei (TW); Ping-Chuan Chu, New Taipei (TW); Shu-Lin Duan, New Taipei (TW); Wei Wan, New Taipei (TW); Ching-Tien Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 24 days.

(21) Appl. No.: 14/601,676

(22) Filed: Jan. 21, 2015

(65) Prior Publication Data

US 2015/0229069 A1 Aug. 13, 2015

(30) Foreign Application Priority Data

Feb. 10, 2014 (CN) ..... 2014 1 0046436

(51) Int. Cl.
*H01R 11/22* (2006.01)
*H01R 13/11* (2006.01)
*H01R 4/18* (2006.01)

(52) U.S. Cl.
CPC ..... *H01R 13/113* (2013.01); *H01R 4/185* (2013.01)

(58) Field of Classification Search
CPC ..... H01R 13/2457
USPC ..... 439/857, 852, 854, 855
See application file for complete search history.

(56) References Cited

U.S. PATENT DOCUMENTS 2,075,632 A * 3/1937 Zuckerman ..... H01R 13/193 439/222
3,120,990 A * 2/1964 Kinkald ..... H01R 4/185 439/849
3,312,931 A * 4/1967 Keller ..... H01R 13/432 439/855
3,609,640 A * 9/1971 Longenecker ..... H01R 13/428 439/345
3,753,193 A * 8/1973 Teagno ..... H01R 13/567 439/854
3,777,301 A * 12/1973 Michaels ..... H01R 25/00 439/749
3,824,557 A * 7/1974 Mallon ..... H01R 12/58 439/381
3,846,735 A * 11/1974 Carter ..... H01R 13/28 439/284
3,853,388 A * 12/1974 Heimbrock ..... H01R 13/567 439/685
3,995,930 A * 12/1976 Herrmann, Jr. ..... H01R 13/53 174/89
4,109,992 A * 8/1978 Hughes ..... H01R 13/567 439/620.21
4,820,179 A * 4/1989 Saijo ..... H01R 4/2466 439/224

(Continued)

FOREIGN PATENT DOCUMENTS

TW M415441 U 11/2011

*Primary Examiner* — Neil Abrams
(74) *Attorney, Agent, or Firm* — Rabin & Berdo, P.C.

(57) ABSTRACT

A terminal has a base, a wire covering portion, two connecting portions and two resilient arms. The resilient arms are formed on and protrude forward respectively from front ends of the connecting portions and each resilient arm has an extension section, a U-turn portion and a folding contacting section. The extension section is formed on and protrudes forward from the front end of one of the connecting portions. The U-turn portion is formed on the extension section. The folding contacting section is formed on and extends from the U-turn portion, is parallel to the other folding contacting section, and abuts an inside surface of the extension section. The terminal is structurally strong and durable.

10 Claims, 12 Drawing Sheets

(56) References Cited

U.S. PATENT DOCUMENTS 5,645,458 A * 7/1997 Hotea ..... H01R 13/113 439/852
5,730,629 A * 3/1998 Samejima ..... H01R 13/113 29/874
6,280,250 B1 * 8/2001 Ko ..... H01R 4/185 439/595
6,478,620 B1 * 11/2002 Bonavita ..... H01R 12/7005 439/589
6,520,811 B2 * 2/2003 Mitani ..... H01R 13/113 439/843
7,252,561 B2 * 8/2007 Nora ..... H01R 13/4223 439/852
7,704,103 B1 * 4/2010 Rhein ..... H01R 13/113 439/752.5
8,241,076 B2 * 8/2012 Kubota ..... H01R 13/113 439/852
2004/0224573 A1 * 11/2004 Yoshida ..... H01R 13/11 439/852

* cited by examiner

TERMINAL FOR AN ELECTRICAL CONNECTOR

BACKGROUND OF THE INVENTION

1. Field of the Invention

The present invention relates to a terminal, and more particularly to a terminal mounted in an electrical connector for signal transmission. The terminal has a resilient contacting arm for excellent electrically contacting and mechanically clamping functions without material fatigue after repeated plugging and pulling actions of the electrical connector. Furthermore, the terminal is manufactured easily such that the manufacturing cost is lowered.

2. Description of Related Art

Electrical connectors are common components of electrical devices and are used to electrically connect different electrical devices such that signal transmission or power supply between the electrical devices is implemented through the electrical connectors.

Taiwan utility model patent No. M415441 discloses an improved terminal mounted in an electrical connector on one end of a signal cable. The electrical connector may be engaged with a corresponding connector fabricated on a motherboard of an electrical device. The terminal has a base, a tail, two conducting portions, two contacting portions and two clamping portions. The tail protrudes from a rear end of the base. The conducting portions protrude from a front end of the base. The contacting portions protrude inward respectively from the conducting portions and extend forward. Each clamping portion extends from one of two sides of a corresponding conducting portion to the other side. Thus, the terminal is able to provide conducting and resiliently clamping effects.

However, the contacting portions of the aforementioned terminal are thin and elongated such that contacting and positioning functions thereof are not ideal. When the electrical connector on which the terminal is mounted suffers repeated plugging and pulling operations, the contacting portions of the terminal are fatigued and become too loose to maintain their original positions. Thus, the terminal cannot provide sufficient contacting force and results in contacting failure. Furthermore, the clamping portions of the terminal are hollow and U-shaped to decrease the clamping ability. The clamping portions are also too structurally complicated to manufacture. Therefore, the terminal has high manufacturing cost and low production yield rate.

To overcome the shortcomings, the present invention provides a terminal for an electrical connector to mitigate or obviate the aforementioned problems.

SUMMARY OF THE INVENTION

The main objective of the invention is to provide a terminal mounted in an electrical connector for signal transmission. The terminal has a resilient contacting arm for excellent electrically contacting and mechanically clamping functions without material fatigue after repeated plugging and pulling actions of the electrical connector. Furthermore, the terminal is manufactured easily such that the manufacturing cost is lowered.

A terminal in accordance with the present invention has a base, a wire covering portion, two connecting portions and two resilient arms. The resilient arms are formed on and protrude forward respectively from front ends of the connecting portions and each resilient arm has an extension section, a U-turn portion and a folding contacting section. The extension section is formed on and protrudes forward from the front end of one of the connecting portions. The U-turn portion is formed on the extension section. The folding contacting section is formed on and extends from the U-turn portion, is parallel to the other folding contacting section, and abuts an inside surface of the extension section. The terminal is structurally strong and durable.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
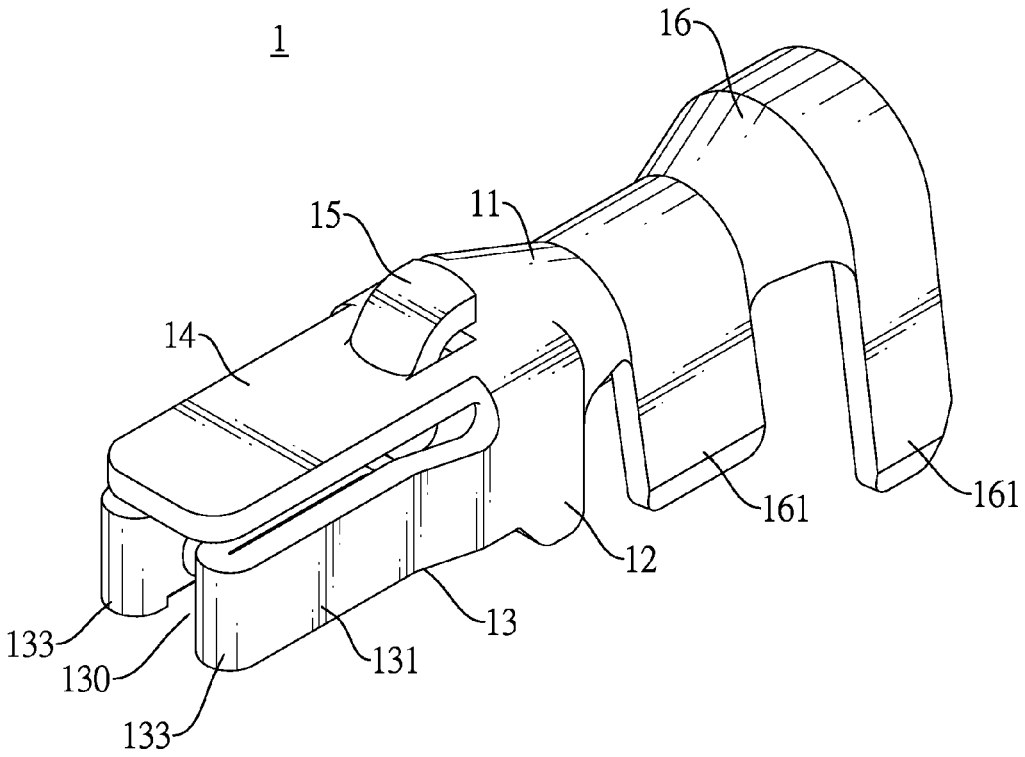
FIG. 1 is a perspective view of a first embodiment of a terminal for an electrical connector in accordance with the present invention.
Figure 6:
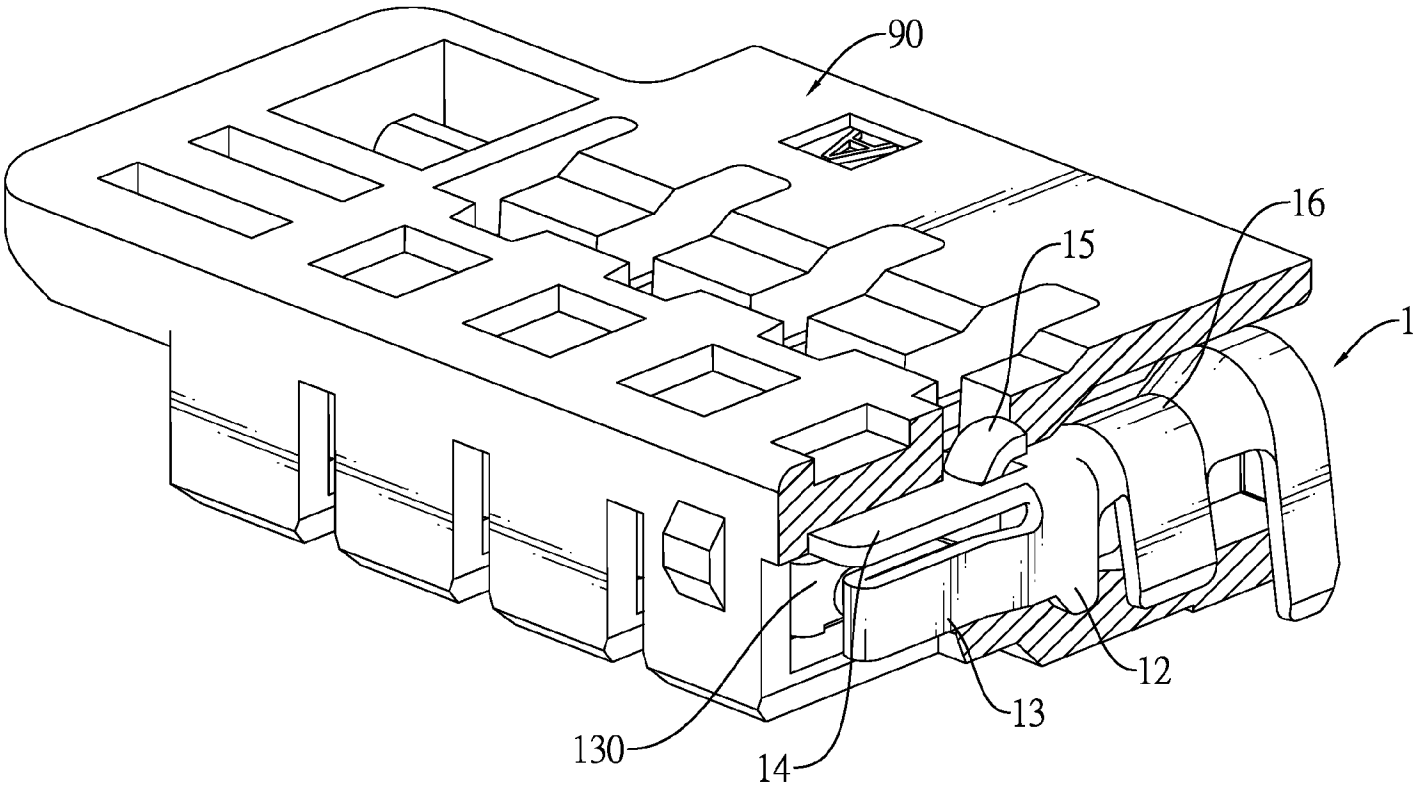
FIG. 6 is an operational and cross sectional side view of the terminal in FIG. 1 mounted in an insulative housing of an electrical connector.
Figure 7:
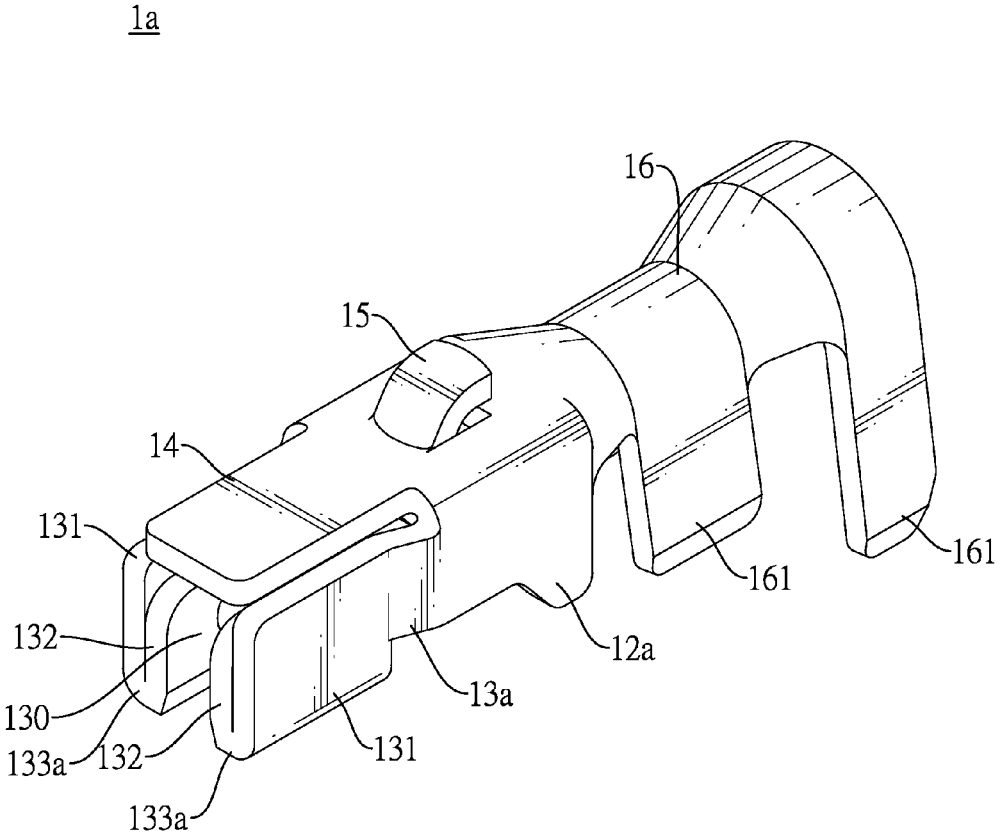
FIG. 7 is a perspective view of a second embodiment of a terminal for an electrical connector in accordance with the present invention.
Figure 8:
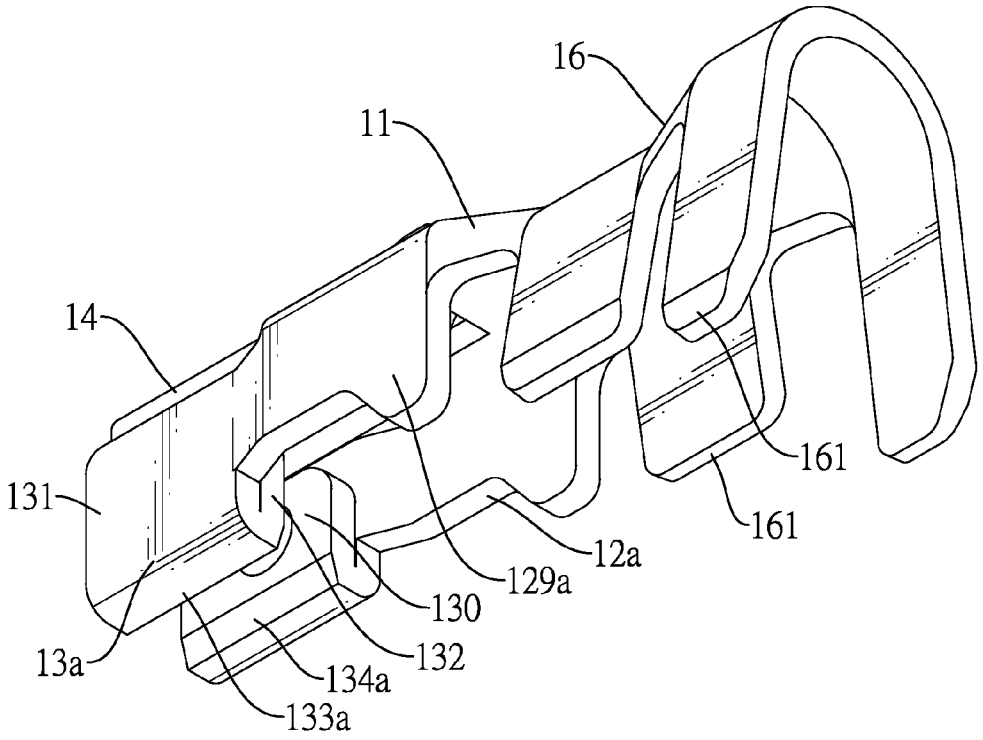
FIG. 8 is another perspective view of the terminal in FIG. 7.
Figure 9:
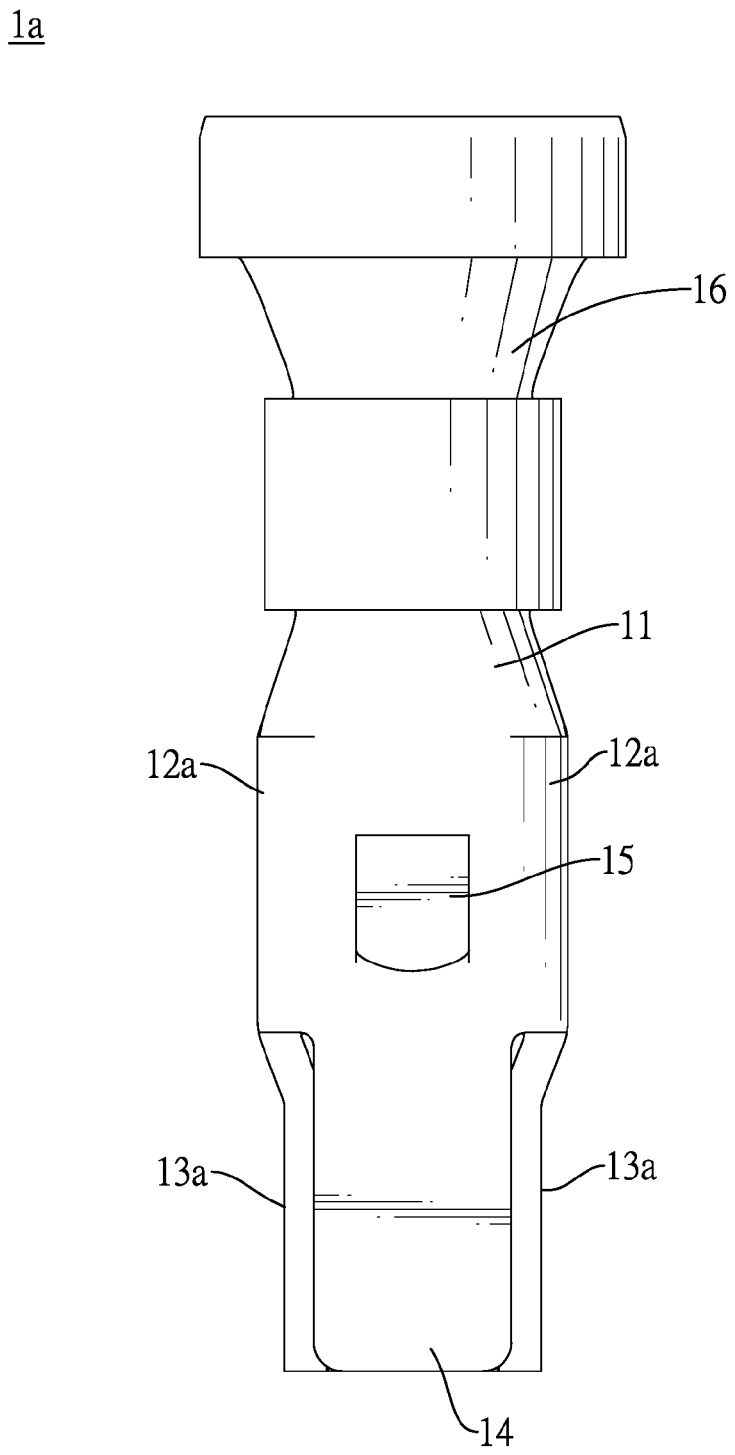
FIG. 9 is a top view of the terminal in FIG. 7.
Figure 10:
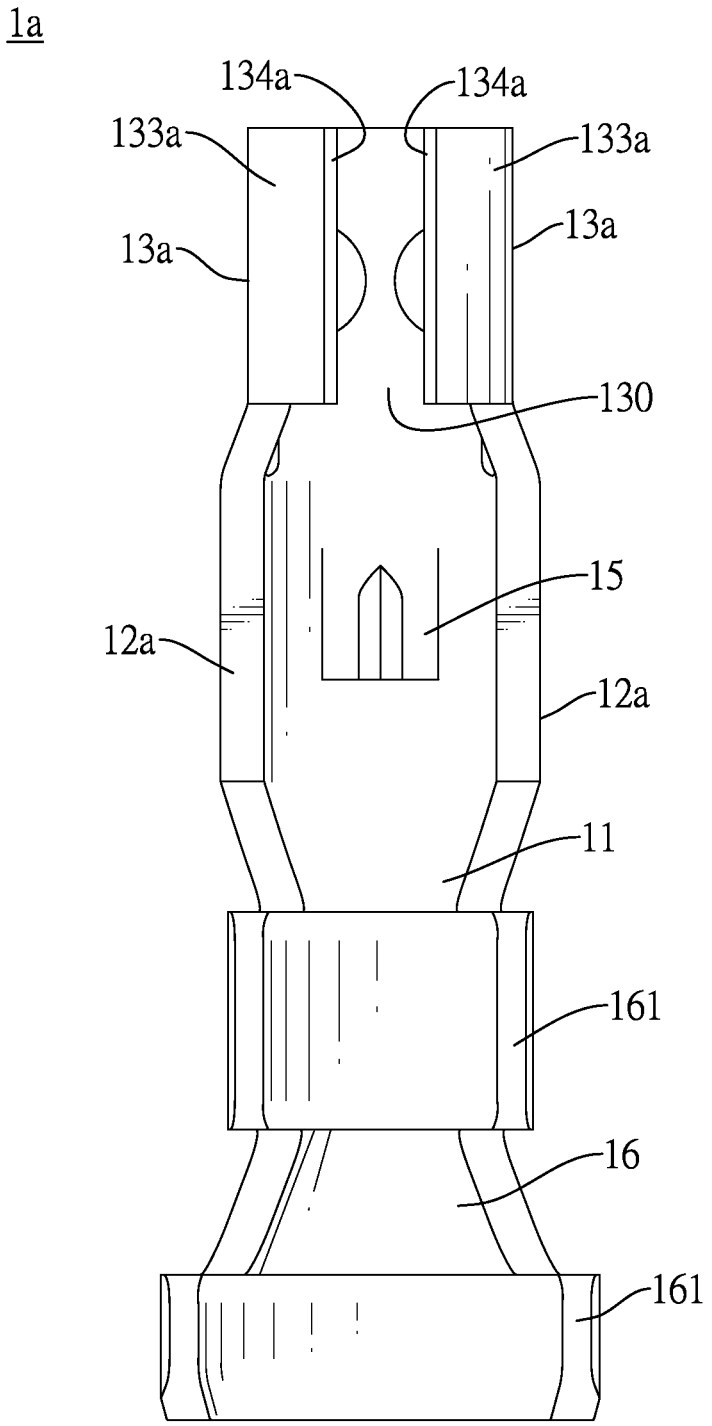
FIG. 10 is a bottom view of the terminal in FIG. 7.
Figure 11:
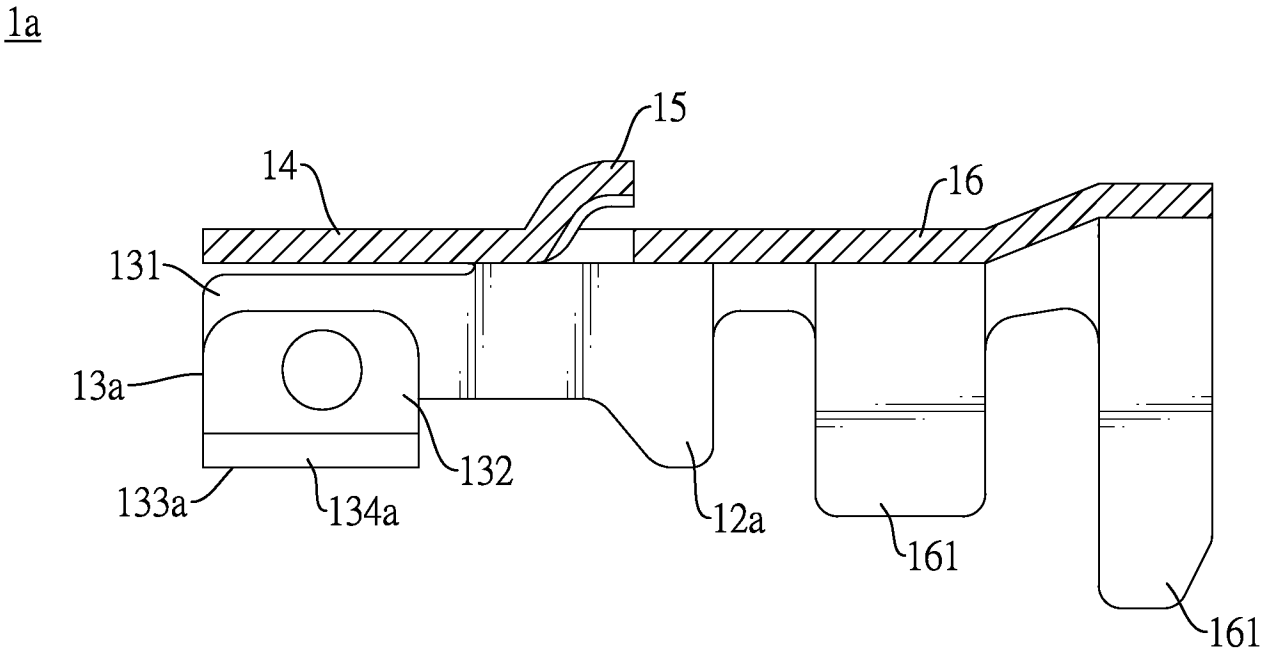
FIG. 11 is a cross sectional side view of the terminal in FIG. 7.
Figure 12:
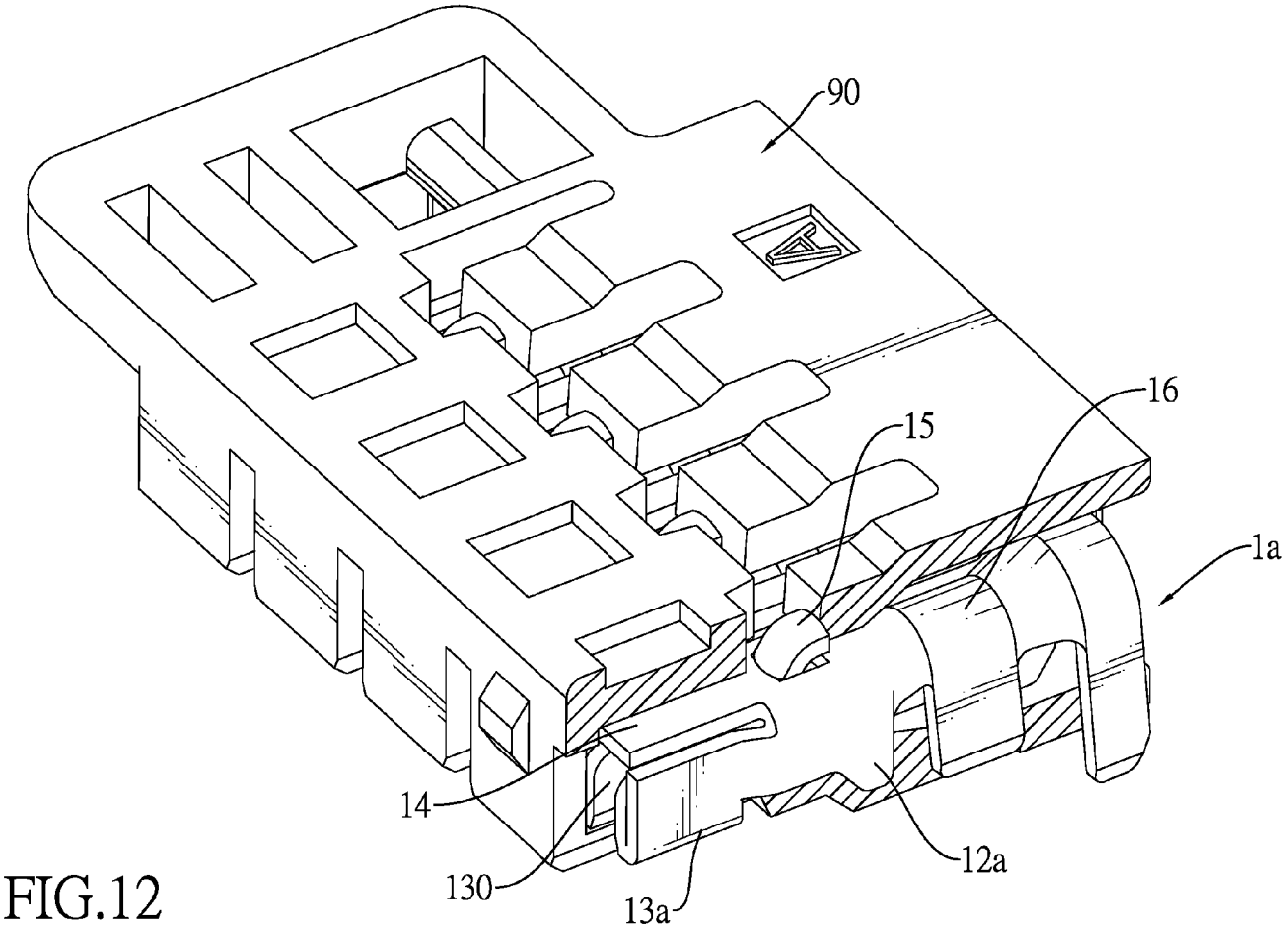
FIG. 12 is an operational and cross sectional side view of the terminal in FIG. 7 mounted in an insulative housing of an electrical connector.

With reference to FIGS. 1 and 6, a first embodiment of a terminal 1 in accordance with the present invention is mounted on an insulative housing 90 of an electrical connector and comprises a base 11, a wire covering portion 16, two connecting portions 12, two resilient arms 13 and an abutting portion 14.

Figure 2:
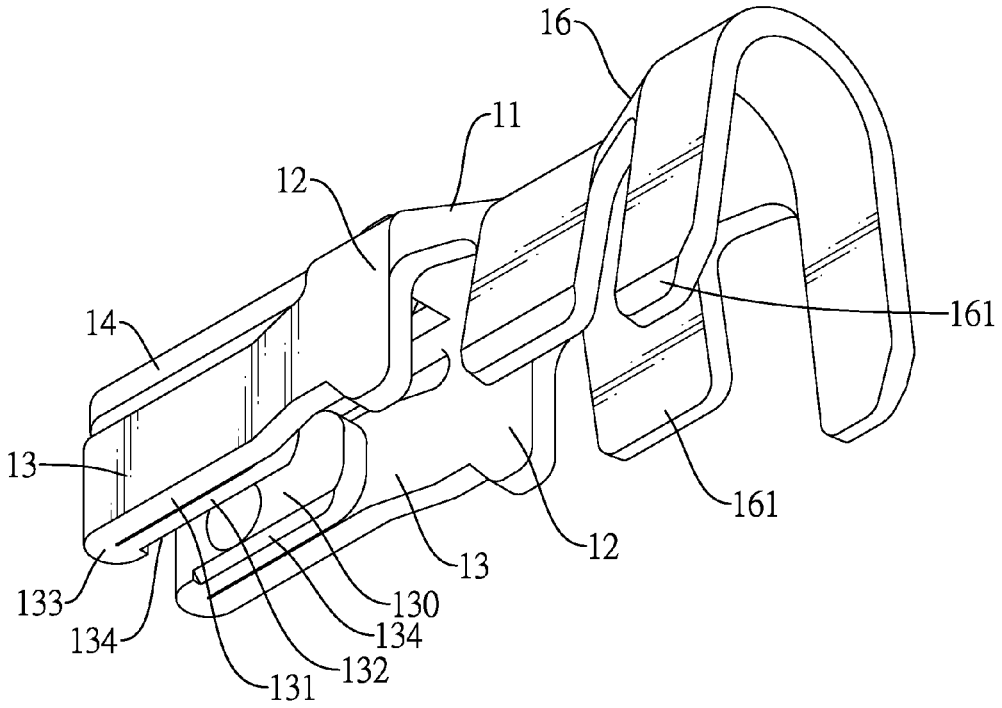
FIG. 2 is another perspective view of the terminal in FIG. 1.
Figure 3:
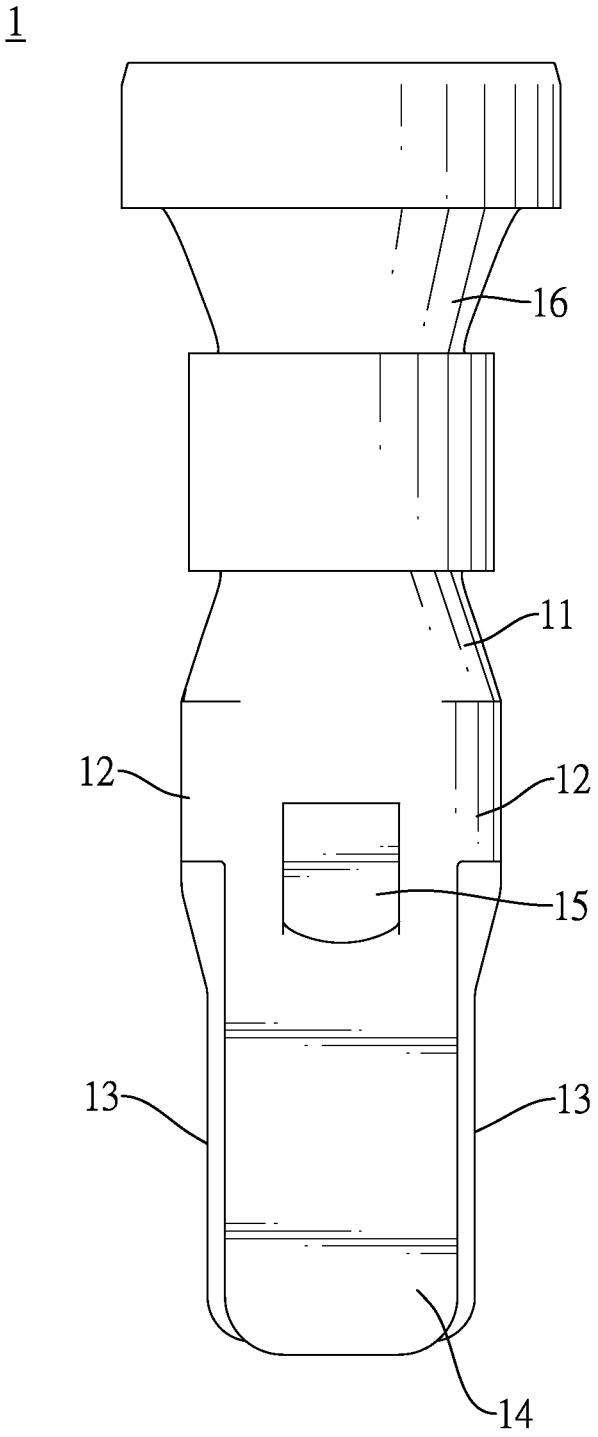
FIG. 3 is a top view of the terminal in FIG. 1.

With further reference to FIGS. 2 and 3, the wire covering portion 16 is formed on and protrudes backward from the base 11 and has multiple pairs of clamping tabs 161. The pairs of the clamping tabs are formed on and protrude downward from the wire covering portion 16 and may be curved to tightly clamp copper wires of a cable connected to the electrical connector.

The connecting portions 12 are formed on and protrude downward respectively from two opposite sides of the base 11.

Figure 4:
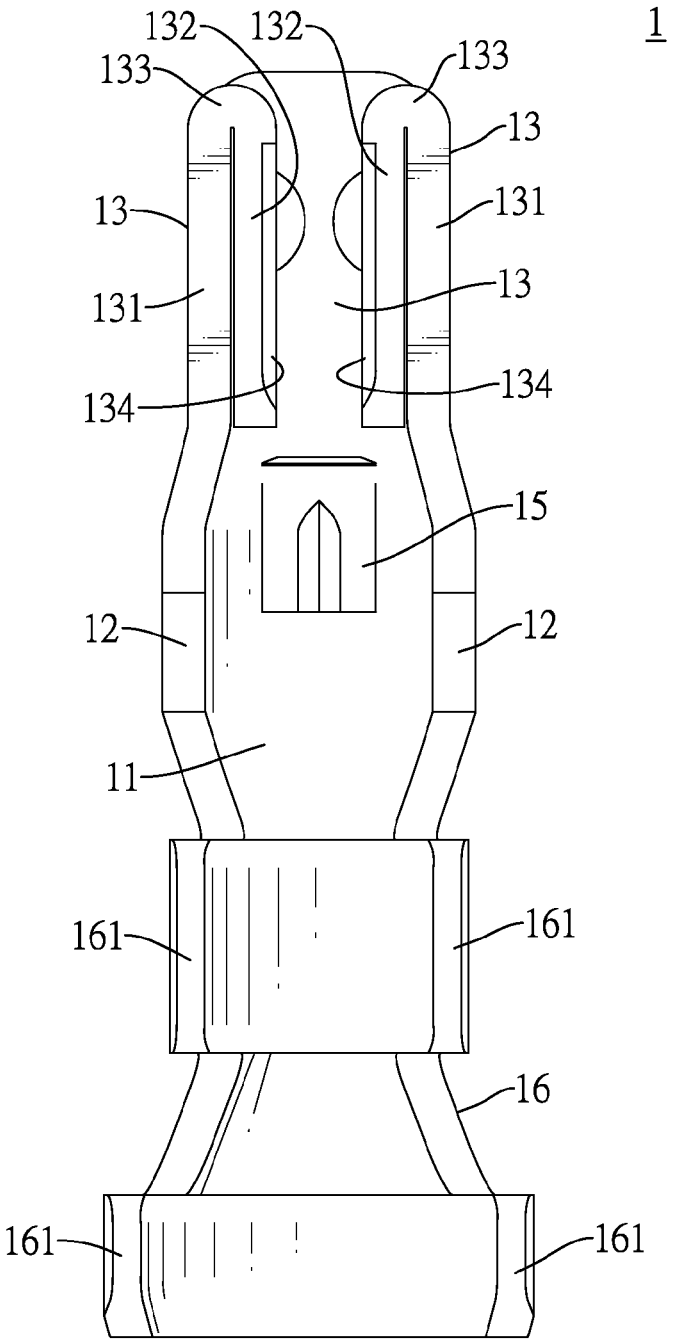
FIG. 4 is a bottom view of the terminal in FIG. 1.
Figure 5:
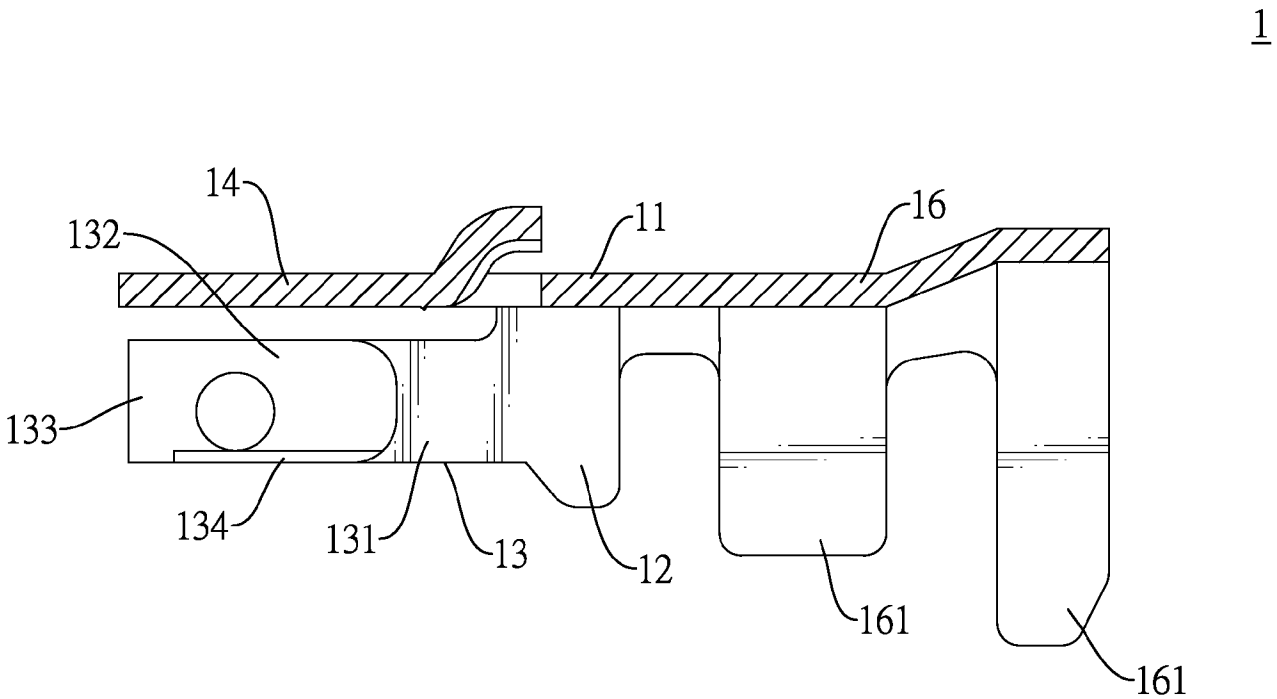
FIG. 5 is a cross sectional side view of the terminal in FIG. 1.

With further reference to FIGS. 4 and 5, the resilient arms 13 are formed by stamping processes, are formed on and protrude forward respectively from front ends of the connecting portions 12, and each resilient arm 13 has an extension section 131, a U-turn portion 133 and a folding contacting section 132.

The extension section 131 is formed on and protrudes forward from the front end of one of the connecting portions 12.

The U-turn portion 133 may be curved, and is formed on the extension section 131. In the first embodiment, the U-turn portion 133 is formed on a front end of the extension section 131.

The folding contacting section 132 is formed on and extends from the U-turn portion 133, is parallel to an inside surface of the extension section 131, and abuts the inside surface of the extension section 131. In the first embodiment, the folding contacting section 132 protrudes backward from the U-turn portion 133. An inserting space 130 is defined between the folding contacting sections 132 of the resilient arms 13. The folding contacting section 132 may further have a guiding slope surface 134 and a contacting bump 136. The guiding slope surface 134 is formed in a bottom edge of the folding contacting section 132 to guide a corresponding terminal of an external electrical connector to smoothly enter the inserting space 130. The contacting bump 136 is formed on and protrudes from an inside surface of the folding contacting section 132 to improve contacting effect.

Preferably, a length of the folding contacting section 132 is substantially equal to a length of the extension section 131.

The abutting portion 14 is formed on and protrudes forward from the base 11 and is located above the resilient arms 13. A front end of the abutting portion 14 may be substantially flush with front ends of the resilient arms 13. The abutting portion 14 may have an embedding protrusion 15 formed on and protruding from the abutting portion 14. The embedding protrusion 15 is embedded into the insulative housing 90 to firmly mount the terminal 1 on the insulative housing 90.

With reference to FIGS. 7 to 12, a second embodiment of the terminal la in accordance with the present invention comprises a base 11, a wire covering portion 16, two connecting portions 12*a*, two resilient arms 13*a* and an abutting portion 14. Each resilient arm 13*a* has an extension section 131, a U-turn portion 133*a*, a folding contacting section 132 and a guiding slope surface 134*a*. The U-turn portion 133*a* of each resilient arm 13*a* is formed on a bottom edge of the extension section 131. The folding contacting section 132 of each resilient arm 13*a* protrudes upward from the U-turn portion 133*a*. Furthermore, a length of the connecting portion 12*a* is longer than a length of the resilient arm 13*a*.

The terminal 1, 1*a* of the present invention has the following advantages.

1. The terminal 1, 1*a* is manufactured from a one-piece metal sheet by stamping processes. Each resilient arm 13, 13*a* is made by folding an elongated metal sheet to form the abutting extension section 131 and the folding contacting section 132 such that the resilient arm 13, 13*a* has a thickness twice the thickness of the metal sheet. Therefore, structural strength of the resilient arm 13, 13*a* of the present invention is twice the structural strength of a conventional one and is able to provide excellent contacting, clamping and electrical conductive functions. The terminal 1, 1*a* of the present invention is durable. When the terminal 1, 1*a* is engaged with a corresponding terminal of another electrical connector, the inserting space 130 of the resilient arms 13, 13*a* accommodates and tightly clamps a contacting portion of the corresponding terminal to achieve excellent contacting and positioning purposes.

2. The resilient arms are formed by bending reversely without any complicated structures of holes or U-shaped configurations, which improves the structural strength, facilitates the manufacture processing and lowers the cost of the resilient arms Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A terminal comprising:

a base;

a wire covering portion formed on and protruding backward from the base;

two connecting portions formed on and protruding downward respectively from two opposite sides of the base; and two resilient arms formed on and protruding forward respectively from front ends of the connecting portions and each resilient arm having an extension section formed on and protruding forward from the front end of one of the connecting portions;

a U-turn portion formed on the extension section; and a folding contacting section formed on and extending from the U-turn portion, and being parallel to an inside surface of the extension section and abutting the inside surface of the extension section, wherein an inserting space is defined between the folding contacting sections of the resilient arms.

2. The terminal as claimed in claim 1, wherein a length of the folding contacting section is substantially equal to a length of the extension section.

3. The terminal as claimed in claim 1, wherein each resilient arm has a guiding slope surface formed in a bottom edge of the folding contacting section.

4. The terminal as claimed in claim 1, wherein each U-turn portion is curved.

5. The terminal as claimed in claim 1, wherein an abutting portion is formed on and protrudes forward from the base and is located above the resilient arms.

6. The terminal as claimed in claim 5, wherein a front end of the abutting portion is substantially flush with front ends of the resilient arms.

7. The terminal as claimed in claim 5, wherein the abutting portion has an embedding protrusion formed on and protruding from the abutting portion.

8. The terminal as claimed in claim 1, wherein the wire covering portion has multiple pairs of clamping tabs formed on and protruding downward from the wire covering portion.

9. The terminal as claimed in claim 1, wherein the U-turn portion of each resilient arm is formed on a front end of the extension section; and the folding contacting section of each resilient arm protrudes backward from the U-turn portion.

10. The terminal as claimed in claim 1, wherein the U-turn portion of each resilient arm is formed on a bottom edge of the extension section; and the folding contacting section of each resilient arm protrudes upward from the U-turn portion.

* * * * *